US007400311B2

(12) United States Patent
Park et al.

(10) Patent No.: US 7,400,311 B2
(45) Date of Patent: Jul. 15, 2008

(54) RESPONSE TIME ACCELERATOR AND METHOD FOR DRIVING LIQUID CRYSTAL DISPLAY

(75) Inventors: Seok-joon Park, Kyungki-do (KR); Hwan-sang Roh, Yongin (KR); Yong-joon Jung, Yongin (KR); Kwang-whui Cho, Yongin (KR); Yong-in Han, Seongnam (KR); Gwang-sun Lee, Yongin (KR)

(73) Assignee: Samsung Electronics Co., Ltd. (KR)

( * ) Notice: Subject to any disclaimer, the term of this patent is extended or adjusted under 35 U.S.C. 154(b) by 610 days.

(21) Appl. No.: 10/697,207

(22) Filed: Oct. 30, 2003

(65) Prior Publication Data

US 2004/0090407 A1 May 13, 2004

(30) Foreign Application Priority Data

Nov. 8, 2002 (KR) ..... 10-2002-0069357

(51) Int. Cl.
*G09G 3/36* (2006.01)

(52) U.S. Cl. ..... 345/87; 345/89; 345/208; 345/214

(58) Field of Classification Search ..... 345/89, 345/208, 214
See application file for complete search history.

(56) References Cited

U.S. PATENT DOCUMENTS 6,091,389 A * 7/2000 Maeda et al. ..... 345/98
6,292,122 B1 * 9/2001 Younis et al. ..... 341/143
2004/0017343 A1 * 1/2004 Adachi et al. ..... 345/87
2004/0125062 A1 * 7/2004 Yamamoto et al. ..... 345/87
2006/0017677 A1 * 1/2006 Ohmuro et al. ..... 345/87

FOREIGN PATENT DOCUMENTS

KR 10-0437749 6/2004

* cited by examiner

*Primary Examiner*—Richard Hjerpe
*Assistant Examiner*—Leonid Shapiro
(74) *Attorney, Agent, or Firm*—Mills & Onello LLP

(57) ABSTRACT

A response time accelerator and method for driving a liquid crystal display (LCD) are provided. According to the response time accelerator for driving an LCD, an acceleration unit reads previous data Pn−1 corresponding to input current data Pn from a frame memory unit that updates and stores one or more frames of previous data Pn−1. The acceleration unit then reads predetermined mapped panel output value TPO, predetermined mapped panel characteristic value TpPn, and flag information corresponding to the previous data Pn−1 and current data Pn from a table memory unit that stores predetermined mapped panel output values TPOs, predetermined mapped panel characteristic values TpPns, and flag information corresponding to the predetermined mapped panel characteristic values TpPns, and decodes the read information. The acceleration unit performs interpolations on the decoded mapped panel output value TPO and mapped panel characteristic value TpPn according to the flag information, and generates liquid crystal panel data PO to be output to a liquid crystal panel and previous data of a next frame pPn to be output to the frame memory unit. Thus, the response time accelerator and method make it possible to improve the response time of the liquid crystal even with respect to image data with extremely large or small gray level value.

29 Claims, 5 Drawing Sheets

RESPONSE TIME ACCELERATOR AND METHOD FOR DRIVING LIQUID CRYSTAL DISPLAY

This application claims priority of Korean Patent Application No. 2002-69357, filed Nov. 8, 2002, the contents of which are incorporated herein by reference in their entirety.

BACKGROUND OF THE INVENTION

1. Field of the Invention

The present invention relates to a liquid crystal display (LCD), and more particularly, to a response time accelerator system and method for driving a liquid crystal display.

2. Description of the Related Art

Current LCD technologies have problems associated with liquid crystal response time. Thus, because the response time of the liquid crystal forming pixels in an LCD panel is relatively slow, a user sees an after image, when a TV displays a large number of moving images.

Each liquid crystal cell within an LCD panel allows light to pass through or blocks the light when an applied bias voltage rotates a lattice. Usually, liquid crystals cannot respond in real-time to data changes since the time required to respond to the bias voltage is on the order of tens of milliseconds and bias voltage applied across the crystal varies from frame to frame (1/75 seconds at SXGA resolution). For example, if the bias voltage applied across the liquid crystal within an LCD panel is set to a gray level of 255 for 8-bit image data, the brightness level after the actual response of the liquid crystal is less than 255, which causes vertical stripe patterns to generate an after image. The liquid crystal response characteristics is aggravated as the frame period decreases due to increased resolution.

The most commonly used method for preventing liquid crystal panel after image retention due to a slow response is to appropriately preprocess image data prior to processing it in a source driver for driving a liquid crystal panel. To implement this technique, a response time accelerator (RTA) has been adopted. However, the RTA has many problems.

In order for the liquid crystal to keep up with current frame data, the RTA basically compares a previous frame data with the current frame data, interpolates the two frame data and finds a new current frame data with respect to which a response time can be accelerated according to the result of the comparison. The current data input to the RTA in real time is compared with the previous frame data stored in a memory such as SDRAM outside the RTA.

A method for accelerating a response time applied to a conventional RTA involves storing four to six most significant bits (MSB's) of RGB (Red, Green, Blue) data as frame data in an external memory such as SDRAM. However, when storing only the MSBs (e.g., n MSBs) in an external memory such as SDRAM as frame data, a pixel data truncation error (PDTE) occurs. If only the MSBs are used as previous frame data Pn−1, the number of gray level levels that can be compared between the previous frame data Pn−1 and current frame data Pn is $(2^n \times 2^n)$ where n bits Pn−1[7:8−n] of previous frame data Pn−1 and n bits Pn[7:8−n] of current frame data Pn are used. This causes an error to occur. That is, a quantization error occurs because the number of gray levels available for comparison is reduced to $(2^n \times 2^n)$ from "256×256", which is the number of gray levels available when 8-bit data is entirely used for each frame data. Here, the term "quantization error" is given because the error occurs sporadically due to unused 8-n LSBs.

For example, assuming a value derived by shifting n bits Pn[7:8-n] of the current frame data Pn to the right by 8-n bit positions is K (e.g., Pn[3:0] if n=4), the quantization error occurs when outputting an overshoot value exceeding or an undershoot value below the current frame data to the panel at gray level $K*2^{(8-N)}$. Eventually, since the quantization error occurs periodically at gray level produced by multiplying $2^{(8-N)}$ by the value derived by shifting current frame data for each gray level by 8-n bit positions, noise is generated at regular intervals in vertical stripes to be displayed on a liquid crystal panel. The above description, as previously mentioned, is under the assumption that the LCD uses 8-bit RGB data for each pixel making it possible to display 256 gray levels.

Here, the new current frame data found by interpolation of the previous frame data Pn−1 and the current frame data Pn is usually stored in a table memory within an RTA. The tabular values stored in the built-in table memory for interpolation, defining overshoot exceeding or undershoot below the current frame data, are experimentally determined based on the liquid crystal characteristics of a panel. For example, given the fact that the response time of liquid crystal in the panel is relatively slow, if the current frame data is greater than the previous frame data, the new current frame data is assigned a tabular value greater than actual data, which is then output to the panel. Similarly, if the current frame data is less than the previous frame data, the current frame data is assigned a tabular value less than the actual data, which is then output to the panel.

Another drawback of the method for accelerating a response time implemented using a conventional RTA is that it limits the amount of overshoot and undershoot for each output data to a gray level range from 0 to 255 since the number of bits of RGB image data is limited to 8. Therefore, if the current frame data Pn has an extremely large value (around a gray level of 255) or an extremely small value (around a gray level of 0), the output data does not have sufficient amount of overshoot or undershoot. For example, if the current frame data Pn has a maximum gray level of 255, it is impossible to give an overshoot greater than the current frame data Pn to the output data since the overshoot is limited to the maximum gray level of 255. Thus, if data output from the panel is at a gray level of 255, the liquid crystal panel will return a value less than 255 in response. Such an overshoot or undershoot limitation makes it difficult to improve a response time.

SUMMARY OF THE INVENTION

The present invention provides a response time accelerator designed to improve the response time of a liquid crystal by eliminating a truncation error.

The present invention also provides a response time acceleration method to improve the response time of a liquid crystal by eliminating a truncation error.

According to an aspect of the present invention, there is provided a response time accelerator for driving a liquid crystal display (LCD) having a frame memory unit, a table memory unit, and an acceleration unit.

The frame memory unit updates and stores one or more frames of previous data. The table memory unit stores predetermined mapped panel output values, predetermined mapped panel characteristic values, and flag information corresponding to the predetermined mapped panel characteristic values. The acceleration unit reads the previous data corresponding to input current data, reads and decodes the predetermined mapped panel output value, predetermined mapped panel characteristic value, and flag information corresponding to the previous data and current data, performs interpolations on the decoded mapped panel output value and mapped panel characteristic value according to the flag information, and generates liquid crystal panel data to be output to a liquid crystal panel and previous data of a next frame to be output to the frame memory unit.

The acceleration unit can include a comparator, a coefficient generator, a table decoder, a panel output interpolator, a frame memory output interpolator, a panel output selector, and a frame memory output selector.

The comparator compares the current data with the previous data and outputs the liquid crystal panel data and the previous data of a next frame with the same value as the current data, or the current data and the previous data. The coefficient generator generates the coefficients to be used for interpolation based on the current data and previous data. The table decoder reads and decodes the predetermined mapped panel output value, predetermined mapped panel characteristic value, and flag information corresponding to the previous data and current data. The panel output interpolator performs interpolation on the decoded predetermined mapped panel output value and generates the liquid crystal panel data. The frame memory output interpolator performs interpolation on the decoded predetermined panel characteristic value and generates the previous data of the next frame. The panel output selector selectively receives the output of the comparator or the output of the panel output interpolator and outputs the liquid crystal panel data. The frame memory output selector selectively receives the output of the comparator or output of the frame memory output interpolator and outputs the previous data of the next frame.

In one embodiment, the flag information is in a first logic state when the current data is the same as the previous data of the next frame, and in a second logic state when the current data is different from the previous data of the next frame.

The interpolation can be performed using the following equation:

$$I=Pn-1[DB-1:DB-n]$$

$$m=Pn[DB-1:DB-n]$$

$$r=Pn-1[DB-(n+1):0]$$

$$s=Pn[DB-(n+1):0]$$

$$A=\{TP(I,m)*(2^{(DB-n)}-r)+TP(I+1,m)*r\}\gg(DB-n)$$

$$C=\{TP(I,m+1)(2^{(DB-n)}-r)+TP(I+1,m+1)*r\}\gg(DB-n)$$

$$PZ=\{A*(2^{(DB-n)}-s)+C*s\}\gg(DB-n)$$

where Pn, Pn−1, and TP denote the current data, previous data, and mapped panel output value or mapped panel characteristic value, respectively, and DB, n, and PZ are the number of data bits, the number of bits after truncation, and an output value, respectively.

Furthermore, in performing the interpolation when the flag information is in a second logic state, the liquid crystal panel data can be obtained by interpolation at a minimum gray level value if the most significant bit (MSB) of the current data is in a first logic state or at a maximum gray level value if the MSB of the current data is in a second logic state. The predetermined mapped panel output values and predetermined mapped panel characteristic values can correspond one-to-one to gray level values determined by MSB bits of the current data and previous data.

The comparison can be performed using the following equation:

$$|(Pn-1)-(Pn)|\leqq THV\rightarrow PO=Pn, pPn=Pn$$

where Pn−1, Pn, THV denote the previous data, the current data, and a predetermined threshold value, respectively, and PO and pPn are the liquid crystal panel data and previous data of the next frame.

According to another aspect of the present invention, there is provided a method for improving a response time of a liquid crystal panel performed by a response time accelerator having a frame memory unit for updating and storing one or more frames of previous data, a table memory unit for storing predetermined mapped panel output values, predetermined mapped panel characteristic values, and flag information corresponding to the predetermined mapped panel characteristic values, and an acceleration unit for generating data to be output to the liquid crystal panel.

The method includes the steps of: receiving current data in the acceleration unit; reading the previous data corresponding to the current data in the acceleration unit; reading and decoding the predetermined mapped panel output value, predetermined mapped panel characteristic value, and flag information corresponding to the previous data and current data in the acceleration unit; performing interpolation on the decoded predetermined mapped panel output value according to the flag information and generating liquid crystal panel data to be output to the liquid crystal panel in the acceleration unit; and performing interpolation on the decoded predetermined mapped panel characteristic value according to the flag information and generating previous data of a next frame to be output to the frame memory unit in the acceleration unit.

The method may further include the step of comparing the current data with the previous data and outputting the liquid crystal panel data and previous data of the next frame with the same value as the current data, or the current data and previous data.

In one embodiment, the flag information is in a first logic state when the current data is the same as the previous data of the next frame, and in a second logic state when the current data is different from the previous data of the next frame.

According to this method, the interpolation can be performed using the following equation:

$$I=Pn-1[DB-1:\mathrm{DB-n}]$$

$$m=Pn[DB-1:DB-n]$$

$$r=Pn-1[DB-(n+1):0]$$

$$s=Pn[DB-(n+1):0]$$

$$A=\{TP(I,m)*(2^{(DB-n)}-r)+TP(I+1,m)*r\}\gg(DB-n)$$

$$C=\{TP(I,m+1)(2^{(DB-n)}-r)+TP(I+1,m+1)*r\}\gg(DB-n)$$

$$PZ=\{A*(2^{(DB-n)}-s)+C*s\}\gg(DB-n)$$

where Pn, Pn−1, and TP denote the current data, previous data, and mapped panel output value or mapped panel characteristic value, respectively, and DB, n, and PZ are the number of data bits, the number of bits after truncation, and an output value, respectively.

Furthermore, in performing the interpolation when the flag information is in a second logic state, the liquid crystal panel data can be is obtained by interpolation at a minimum gray level value if the most significant bit (MSB) of the current data is in a first logic state or at a maximum gray level value if the MSB of the current data is in a second logic state.

The predetermined mapped panel output values and predetermined mapped panel characteristic values can correspond one-to-one to gray level values determined by MSB bits of the current data and previous data.

According to this method, the comparison can be performed using the following equation:

$$|(Pn-1)-(Pn)| \leq THV \rightarrow PO=Pn, pPn=Pn$$

where Pn−1, Pn, and THV denote the previous data, the current data, and a predetermined threshold value, respectively, and PO and pPn are the liquid crystal panel data and previous data of the next frame.

BRIEF DESCRIPTION OF THE DRAWINGS

The foregoing and other objects, features and advantages of the invention will be apparent from the more particular description of a preferred embodiment of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Figure 1:
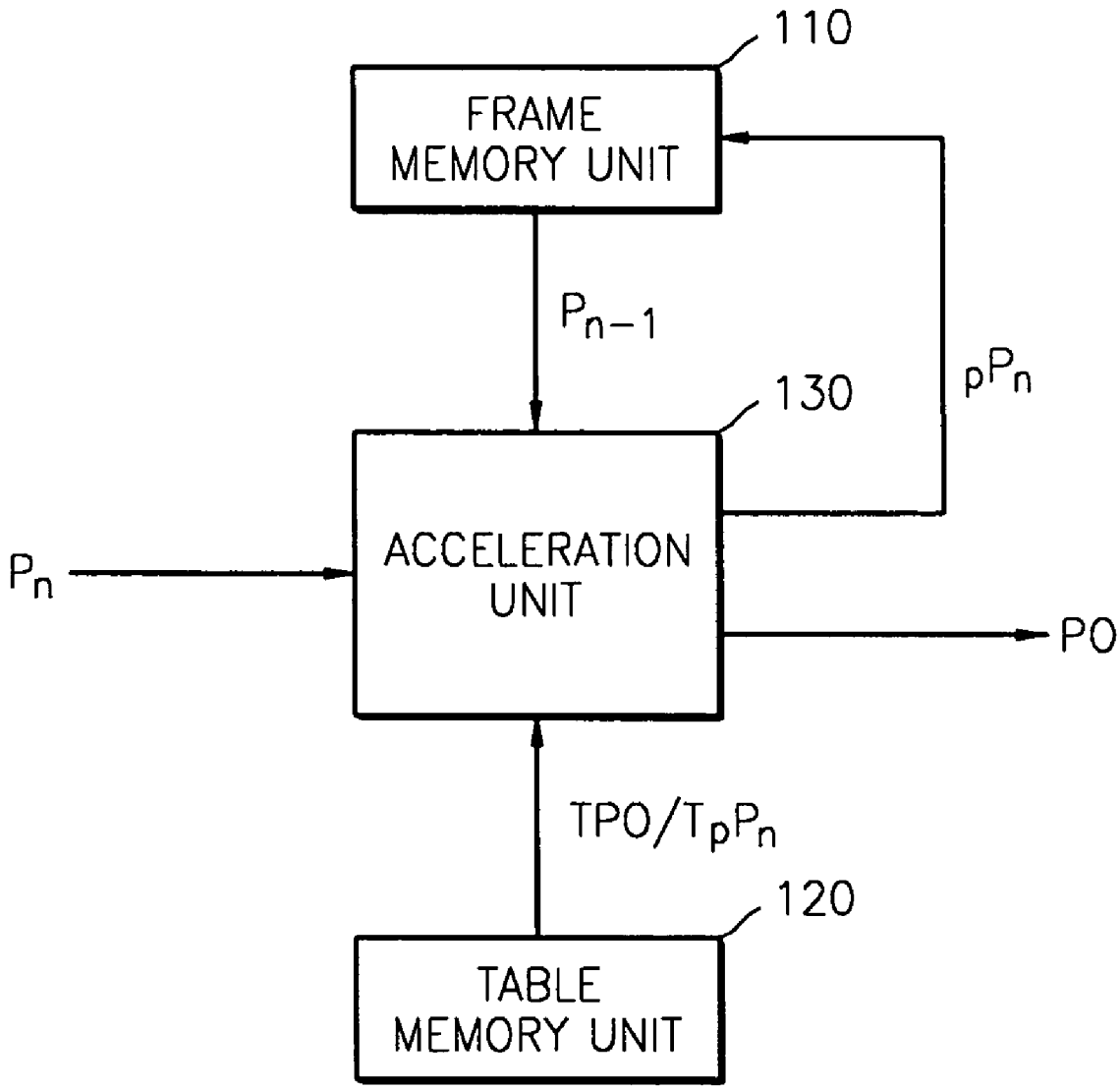
FIG. 1 contains a block diagram of a response time accelerator for driving a liquid crystal display (LCD) according to the present invention.

FIG. 1 shows a response time accelerator for driving a liquid crystal display (LCD) according to the present invention.

Referring to FIG. 1, a response time accelerator for driving a liquid crystal display (LCD) according to the present invention includes a frame memory unit 110, a table memory unit 120, and an acceleration unit 130. The frame memory unit 110 updates and stores one or more frames of previous data Pn−1. Here, the frame memory unit 110 stores data Pn−1 (hereinafter called "previous data"), which is one frame before current frame data Pn (hereinafter called "current data"), corresponding to the current data and transmitted to the same pixel in the liquid crystal panel.

The table memory unit 120 stores predetermined mapped panel output values TPOs, predetermined mapped panel characteristic values TpPns, and flag information corresponding to the predetermined mapped panel characteristic values TpPns. Here, the previous data Pn−1 and flag information corresponding to the previous data Pn−1 are required to perform interpolation according to the present invention. Here, the predetermined mapped panel output value TPO and the predetermined mapped panel characteristic values TpPn, both of which are tabular values used for interpolation, define an overshoot value exceeding or undershoot values below the current data Pn and are experimentally determined based on the liquid crystal characteristics of the panel.

In particular, the predetermined mapped panel output value TPO is a tabular value generally used to correct the gray level of current data Pn to another gray level that best suits the characteristics of the liquid crystal panel. The predetermined mapped panel characteristic value TpPn, necessary to perform more specific interpolation, is a tabular value which corresponds to a response gray level of the liquid crystal panel obtained experimentally with respect to the gray level of current data Pn. The tabular value TpPn is used to compensate for poor response because the liquid crystal panel actually cannot normally respond in spite of correction using the predetermined mapped panel output value TPO.

The acceleration unit 130 reads the previous data Pn−1, corresponding to input current data Pn, reads and decodes the predetermined mapped panel output value TPO, predetermined mapped panel characteristic value TpPn, and flag information corresponding to the previous data Pn−1 and current data Pn, performs interpolations on the decoded mapped panel output value TPO and mapped panel characteristic value TpPn according to the flag information, and produces liquid crystal panel data PO to be output to the liquid crystal panel and previous data of next frame pPn (data which will be the previous data in the next frame) to be output to the frame memory unit 110.

Figure 2:
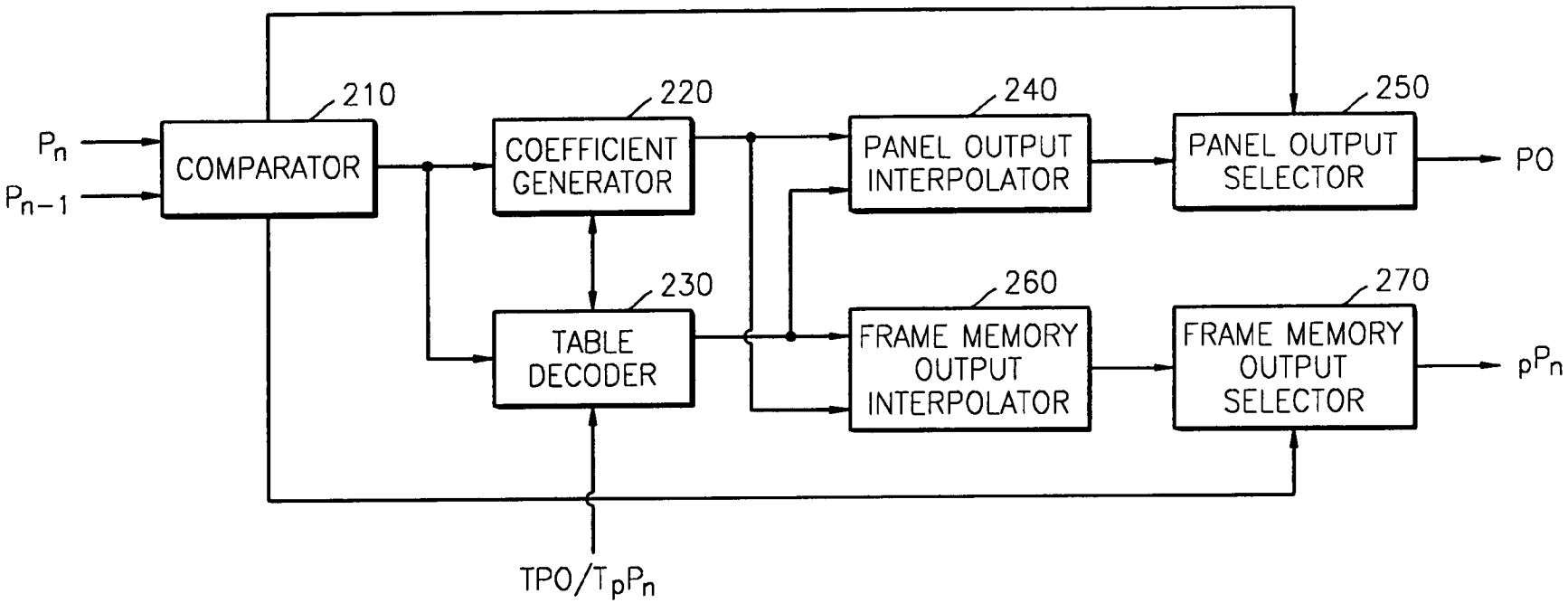
FIG. 2 contains a block diagram of the acceleration unit of FIG. 1.

FIG. 2 shows the acceleration unit 130 of the response time accelerator for driving a liquid crystal panel according to the present invention. Referring to FIG. 2, the acceleration unit 130 includes a comparator 210, a coefficient generator 220, a table decoder 230, a panel output interpolator 240, a frame memory output interpolator 260, a panel output selector 250, and a frame memory output selector 270. The comparator 210 compares the current data Pn with the previous data Pn−1 and outputs the liquid crystal panel data PO and the previous data of next frame pPn with the same value as the current data Pn, or the current data Pn and the previous data Pn−1. In addition, the comparator 210 reads the previous data Pn−1 from the frame memory unit 110.

The coefficient generator 220 generates the coefficients to be used for interpolation based on the current data Pn and previous data Pn−1. The table decoder 230 reads and decodes the predetermined mapped panel output value TPO, predetermined mapped panel characteristic value TpPn, and flag information corresponding to the previous data Pn−1 and current data Pn. The panel output interpolator 240 performs interpolation on the decoded predetermined mapped panel output value TPO and generates the liquid crystal panel data PO. The frame memory output interpolator 260 performs interpolation on the decoded predetermined panel characteristic value TpPn and generates the previous data of next frame pPn.

The panel output selector 250 selectively receives the output of the comparator 210 or the output of the panel output interpolator 240 and outputs the liquid crystal panel data PO. The output liquid crystal panel data PO is input to the LCD panel and drives the liquid crystal. More specifically, the liquid crystal panel data PO is input to a source driver that drives the liquid crystal panel. The source driver drives the liquid crystal panel by processing a signal according to the resolution characteristics of the liquid crystal panel, thus allowing an image to be displayed on LCD. The frame memory output selector 270 selectively receives the output of the comparator 210 or output of the frame memory output interpolator 260 and outputs the previous data of next frame pPn.

The flag information is in a first logic state, i.e., a logic low state, where the current data Pn is the same as the previous data of next frame pPn, while it is in a second logic state, i.e., a logic high state, where the former is different from the latter. The first logic state refers to a state in which the liquid crystal pixels are accelerated fully so that liquid crystal pixels are fully charged to the current data Pn. The second logic state denotes a state in which the liquid crystal pixels did not respond fully so that the liquid crystal pixels are not fully charged to the current data Pn. Thus, if the flag information is in the second logic state, as described below, the current data Pn is obtained by interpolation at a maximum or minimum gray level and output to the liquid crystal panel.

The interpolation is performed using equation (1):

$$I=Pn-1[DB-1:DB-n]$$

$$m=Pn[DB-1:DB-n]$$

$$r=Pn-1[DB-(n+1):0]$$

$$s=Pn[DB-(n+1):0]$$

$$A=\{TP(I,m)*(2^{(DB-n)}-r)+TP(I+1,m)*r\}\gg(DB-n)$$

$$C=\{TP(I,m+1)\ (2^{(DB-n)}-r)+TP(I+1,m+1)*r\}\gg(DB-n)$$

$$PZ=\{A*(2^{(DB-n)}-s)+C*s\}\gg(DB-n) \quad (1)$$

where Pn, Pn−1, and TP denote the current data, previous data, and mapped panel output value or mapped panel characteristic value, respectively, and DB, n, and PZ are the number of data bits, the number of bits after truncation, and an output value, respectively.

Here, as indicated above, DB and n denote the number of bits in image data and the number of bits after truncation. For example, if three LSB bits are truncated in the case of 8-bit image data, all the remaining bits are five MSB bits, and therefore n is 5. Unless specified otherwise, it is assumed that DB is 8. The output value PZ means the liquid crystal panel data PO if TP is the mapped panel output value TPO or the previous data of next frame pPn if TP is the mapped panel characteristic value TpPn. The symbol "≫" denotes shifting of bits. For example, "TP(I, m)≫4" refers to a value obtained by shifting the TP value corresponding to (I, m) (DB-bit, i.e., 8-bit value) to the right by 4 bit positions. This means that if TP(1,m) is "11110000", "TP(I, m)≫4" is "00001111".

In particular, when the flag information is in the second logic state, the liquid crystal panel data PO is obtained by interpolation at a minimum gray level if MSB of the current data Pn is in the first logic state and at a maximum gray level if MSB is in the second logic state. The predetermined mapped panel output values TPOs and mapped panel characteristic values TpPns correspond one-to-one to gray level levels determined by MSB bits of the current data Pn and previous data Pn−1.

The comparison between the current data Pn and previous data Pn−1 performed by the comparator 210 is performed using Equation (2):

$$|(Pn-1)-(Pn)|\leqq THV\rightarrow PO=Pn, pPn=Pn \quad (2)$$

where Pn−1, Pn, and THV denote the previous data, the current data, and a predetermined threshold value, respectively, and PO and pPn are liquid crystal panel data and previous data of next frame.

That is, if the absolute value of "(Pn−1)−(Pn)" is within the range indicated in Equation (2), the comparator 210 outputs liquid crystal panel data PO and previous data of next frame pPn which are the same as the current data Pn. Here, "(Pn−1)−(Pn)" is zero in the case of a still image. However, Equation (2) means that if the absolute value of "(Pn−1)−(Pn)" does not exceed the predetermined threshold value THV, the comparator 210 outputs the liquid crystal panel data PO and previous data of next frame pPn with the same value as the current data Pn even if the current data Pn affected by noise is somewhat different from the previous data Pn−1. The predetermined threshold value THV is set to 4 or 8 in a decimal number or "00000100" or "00001000" in a binary number. The predetermined threshold value THV may be set to another value considering the noise characteristics of the liquid crystal panel.

In contrast, if the absolute value of "(Pn−1)−(Pn)" is not within the range indicated in Equation (2) (or exceeds the predetermined threshold value THV), the comparator 210 outputs the input current data Pn and previous data Pn−1. The current data Pn and previous data Pn−1 output intact from the comparator 210 and the flag information are used for interpolation according to the present invention. That is, if the current data Pn is greater than the previous data Pn−1, the current data Pn is obtained by interpolation at generate the liquid crystal panel data PO which is greater than the current data Pn. Conversely, if the current data Pn is less than the previous data Pn−1, the current data Pn is obtained by interpolation at generate the liquid crystal panel data PO which is less than the current data Pn.

Figure 3:
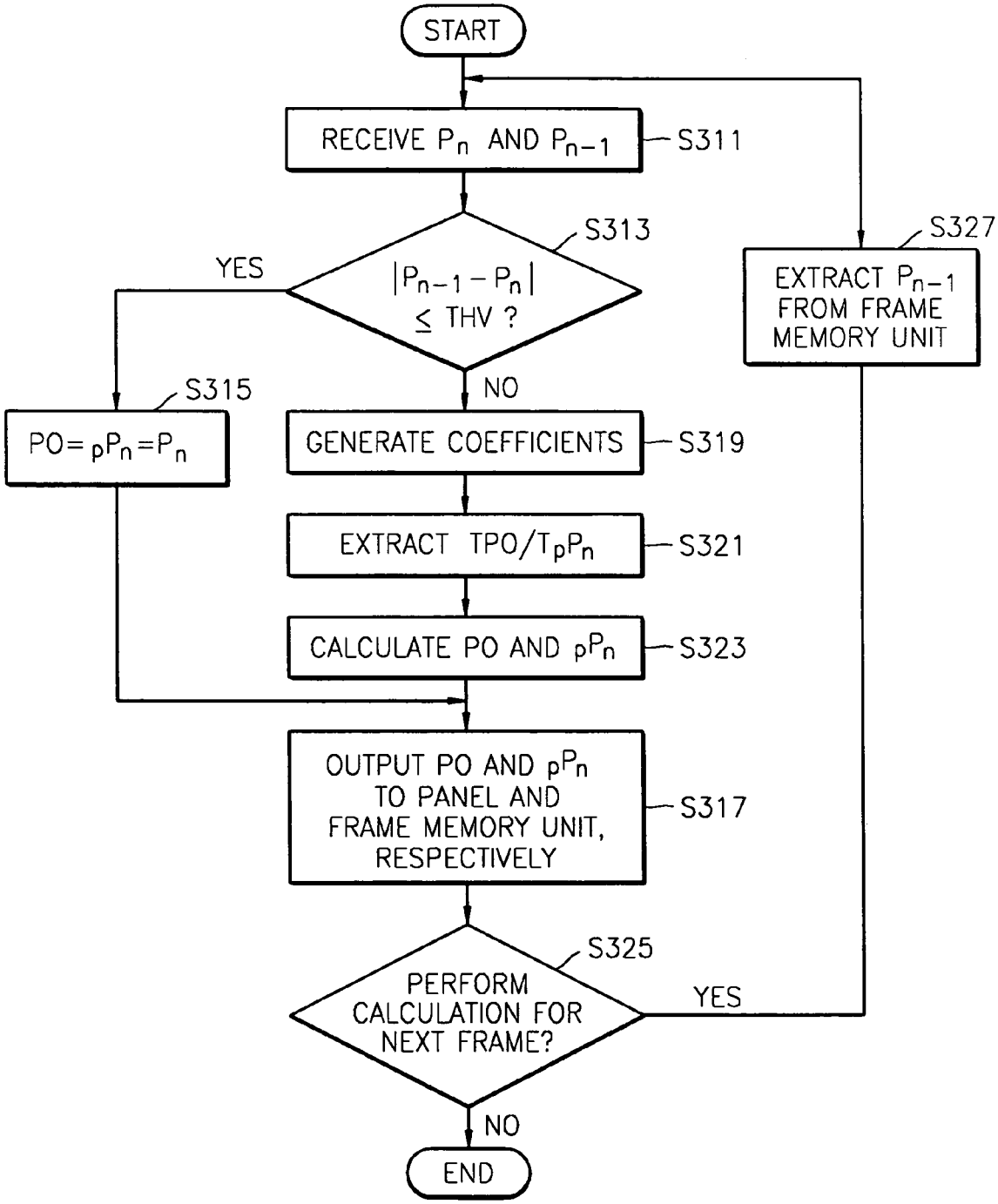
FIG. 3 is a flowchart showing the operation of a response time accelerator for driving an LCD according to the present invention.

The operation of a response time accelerator for driving an LCD according to the present invention will now be described in detail. FIG. 3 is a flowchart showing the operation of the response time accelerator according to this invention. Referring to FIG. 3, the acceleration unit 130 receives the current data Pn and reads the previous data Pn−1 corresponding to the current data Pn (step S311). Here, the current data Pn is received from a graphic card in a computer main frame and RGB image data with a size corresponding to a predetermined resolution. The acceleration unit 130 reads the previous data Pn−1, which is one frame before the current data Pn, from the frame memory unit 110 such as an SDRAM. When reading the relevant data from the frame memory unit 110, the comparator 210 or a separate reader may be used.

Then, the comparator 210 of the acceleration unit 130 determines whether Equation (2) is satisfied. In this case, if the absolute value of "(Pn−1)−(Pn)" is within the range indicated in Equation (2), the comparator 210 outputs liquid crystal panel data PO and previous data of next frame pPn which will be previous data in the next frame as the current data Pn (step S315). Conversely, if the absolute value of "(Pn−1)−(Pn)" is not within the range indicated in Equation (2), i.e., exceeds the predetermined threshold value THV, the comparator 210 outputs the input current data Pn and previous data Pn−1. Then, output current data Pn and previous data Pn−1 are used driving interpolation.

In order to perform interpolation, first, the coefficient generator 220 generates the coefficients necessary for interpolation from the current data Pn and previous data Pn−1(step S319). The coefficients required for interpolation are the consultants I, m, r, s, etc., indicated in Equation (1). For example, if DB is 8 and n is 4, m is Pn[7:4], and Pn[[7:4] means a value (4-bit gray level) obtained by converting. 4-bit MSB data among 8-bit data into a decimal number. Here, since r and s are determined by 8-n LSB bits, this eliminates a truncation error occurring when using the conventional technique. That is, the use of the LSB bits for calculating r and s removes noise generated at regular intervals in a vertical strip pattern to be displayed on an LCD.

Next, the table decoder 230 reads the mapped panel output value TPO, mapped panel characteristic value TpPn, and flag information corresponding to the current data Pn and the previous data Pn−1 from the table memory unit 120 and decodes the read information (step S321). The values TPO and TpPn are used when calculating A and C in Equation (1).

Figure 4:
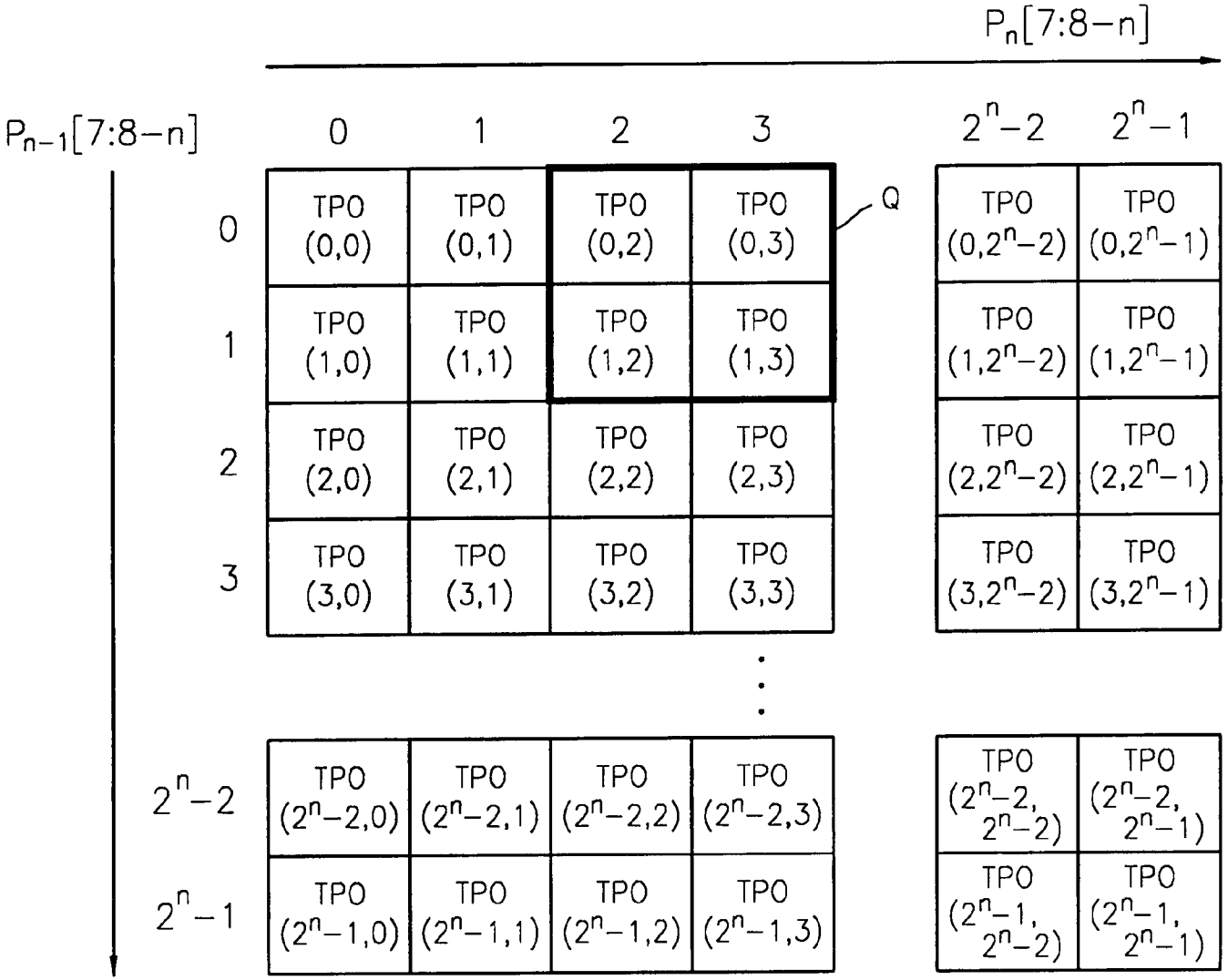
FIG. 4 shows mapped values (TPO/TpPn) for each gray level stored in the table memory unit of FIG. 1.

FIG. 4 shows mapped values TPO/TpPn for each gray level stored in the table memory unit 120. Referring to FIG. 4, if 4 bits are truncated in 8-bit image data so n is 4, Pn[7:4] and Pn−1[7:4] have gray levels of 0 through 15. The mapped value stored in the table memory unit 120 correspond one-to-one to each gray level and is represented by coordinates of gray level values of the current data Pn and previous data Pn−1. Although FIG. 4 shows only mapped panel output values TPOs, the mapped panel characteristic values TpPns also correspond one-to-one to each gray level and are represented by coordinates of gray level values of the current data Pn and previous data Pn−1. The difference is that the number of bits in the mapped panel characteristic value TpPn is one bit higher than the number in the mapped panel output value TPO since the former also contains its corresponding flag information.

In this way, the predetermined mapped panel output values TPOs and predetermined mapped panel characteristic values TpPns correspond one-to-one to each gray level value determined by MSB bits of the current data Pn and previous data Pn−1. Here, values TPO and TpPn each may be arranged in equally sized square tables with respect to all image data bits (256 gray levels), but those values are mapped to gray level values produced only with respect to MSB bits in order to reduce the amount of memory used. TP(I,m), TP(I+1,m), TP(I,m+1), and TP(I+1,m+1) shown in Equation (1) above correspond to four tabular values indicated by Q of FIG. 4 where I=2 and m=0.

After the coefficient generator 220 and the table decoder 230 have obtained or decoded values required for calculation of Equation (1), the panel output interpolator 240 performs interpolation on the decoded mapped panel output value TPO according to Equation (1) and generates liquid crystal panel data PO to be output to the liquid crystal panel. Here, PZ obtained by the panel output interpolator 240 using Equation (1) is the liquid crystal panel data PO.

However, if the decoded flag information is in the second logic state, i.e., a logic high state, it means the liquid crystal pixels did not respond fully. In this case, the liquid crystal panel data PO generated from interpolation performed by the liquid crystal panel interpolator 240 is determined by the current data Pn. That is, if MSB of the current data Pn is in the second logic state, i.e, logic high state, the liquid crystal panel data PO is obtained by interpolation as a maximum gray level value (e.g., 255 in 8-bit data) while if MSB is in the first logic state, i.e., logic low state, the same data is obtained by interpolation as a minimum gray level value (e.g., 0 in 8-bit data). That is, when the flag information is in the second logic state, the liquid crystal panel data PO is obtained by interpolation at a minimum or maximum gray level value. Using the flag information in this way makes it possible for the liquid crystal pixels to be accelerated fully with respect to values around the minimum and maximum gray levels.

The frame memory output interpolator 260 interpolates the decoded mapped panel characteristic value TpPn according to Equation (1) and generates previous data of next frame pPn to be output to the frame memory unit 110 (step S323). In this case, PZ obtained by the frame memory output interpolator 260 using Equation (1) is the previous data of next frame pPn. Here, the previous data of next frame pPn thus generated and mapped panel characteristics corresponding to the current data Pn and previous data Pn−1 are identical to each other if the current data Pn is the same as the previous data Pn−1. This is because the previous data of next frame pPn refers to data which will be the previous data in the next frame and is obtained by performing interpolation in such a way as to predict the response characteristics of the panel.

In this case, when generating the previous data of next frame pPn by obtaining through interpolation the decoded mapped panel characteristic value TpPn according to Equation (1), if the previous data of next frame pPn is the same as the current data Pn, this means that the decoded flag information is stored in the first logic state, i.e., the logic low state. That is, this is the case where the liquid crystal pixels are accelerated fully. Conversely, if the previous data of next frame pPn is different from the current data Pn, this means the decoded flag information is stored in the second logic state, i.e., logic high state. That is, this is the case where the liquid crystal pixels did not respond fully. To prevent incomplete acceleration, the liquid crystal panel is obtained by interpolation as a maximum or minimum gray level.

Each liquid crystal panel data PO output from the comparator 210 and the panel output interpolator 240 is sent to the panel output selector 250 which in turn outputs the liquid crystal panel data PO received from the comparator 210 to the liquid crystal panel if Equation (2) is satisfied (step S317). On the other hand, the panel output selector 250 outputs the liquid crystal panel data PO received from the panel output interpolator 240 to the liquid crystal panel if Equation (2) is not satisfied (step S317). Similarly, the previous data of next frame pPn each output from the comparator 210 and the frame memory output interpolator 260 are sent to the frame memory output selector 270 which in turn outputs the previous data of next frame pPn received from the comparator 210 to the frame memory unit 110 if Equation (2) is satisfied (step S317). The frame memory output selector 270 outputs the previous data of next frame pPn received from the frame memory output interpolator 260 to the frame memory unit 110 if Equation (2) is not satisfied (step S317).

After having output the liquid crystal panel data PO and the previous data of next frame pPn with respect to a frame in this way, the acceleration unit 130 of the response time accelerator according to this invention reads the previous data Pn−1 and its corresponding flag information from the frame memory unit 110 and repeats the above operation with respect to the next frame (step S325~S327).

Figure 5:
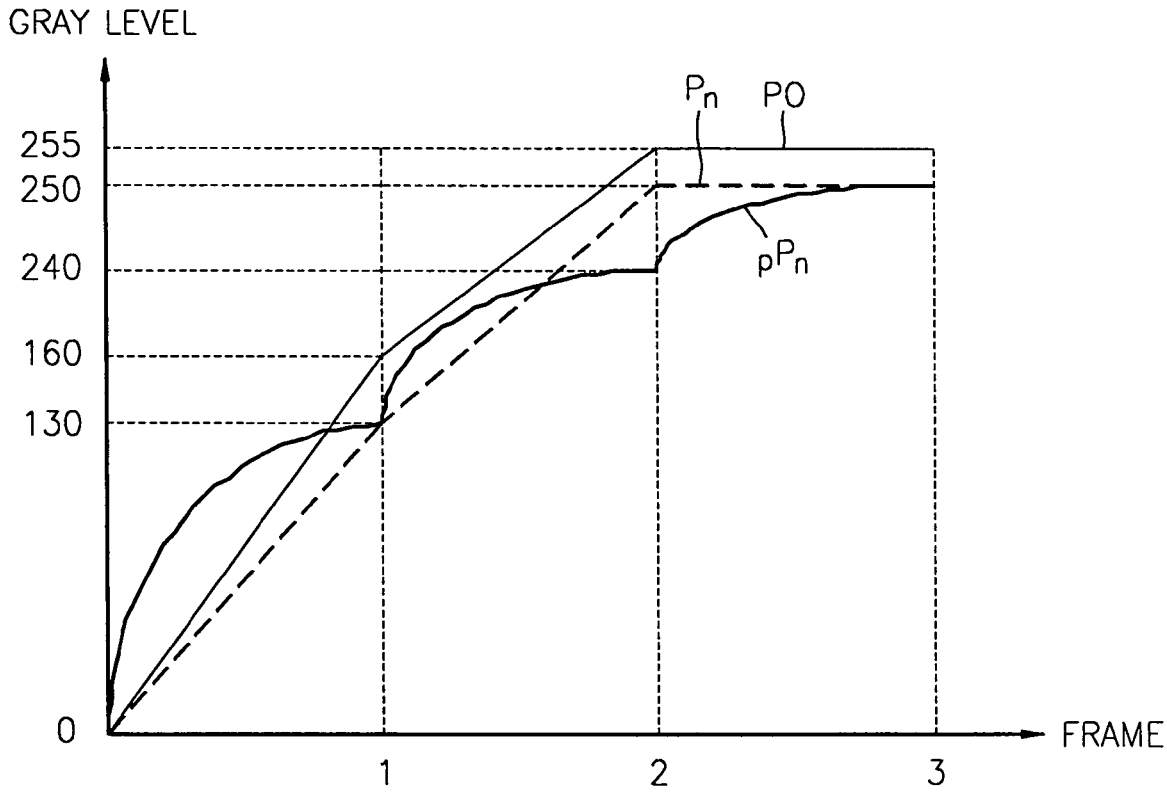
FIG. 5 is a graph showing interpolation performed by a response time accelerator for driving an LCD according to the present invention.

An interpolation method performed by a response time accelerator for driving an LCD according to this invention will now be described in detail by presenting characteristics thereof. FIG. 5 is a graph illustrating an interpolation method performed by a response time accelerator for driving an LCD according to the present invention. Referring to FIG. 5, the current data Pn has gray levels of 130, 250, and 250 in first through third frames, respectively. In this case, the liquid crystal panel data PO generated by the liquid crystal output interpolator 240 has gray levels of 160, 255, and 255. The previous data of next frame pPn generated by the frame memory output interpolator 260 has gray levels of 130, 240, and 250.

In FIG. 5, the current data Pn in the first frame has a gray level of 130 while the previous data Pn−1 has a gray level of 0. In this case, the liquid crystal panel data PO and the previous data of next frame pPn generated according to the interpolation method as described above have gray levels of 160 and 130, respectively. Here, since the current data Pn is the same as the previous data of next frame pPn and the liquid crystal pixels are accelerated fully, the flag information corresponding to the mapped panel characteristic value TpPn is in the first logic state, i.e., the logic low state. That is, the liquid crystal panel interpolator 240 generates the liquid panel data PO with a gray level of 160 using Equation (1)

while the frame memory output interpolator 260 generates the previous data of next frame pPn with a gray level of 130 using Equation (1).

The current data Pn in the second frame has a gray level of 250 while the previous data Pn−1 has a gray level of 130. In this case, the liquid crystal panel data PO and the previous data of next frame pPn generated according to the interpolation method as described above have gray levels of 255 and 240, respectively. Here, since the current data Pn is different from the previous data of next frame pPn and the liquid crystal pixels did not respond fully, the flag information corresponding to the mapped panel characteristic value TpPn is in the second logic state, i.e., logic high state. That is, the liquid crystal panel interpolator 240 generates the liquid panel data PO with a gray level of 255 using Equation (1) while the frame memory output interpolator 260 generates the previous data of next frame pPn with a gray level of 240 using Equation (1). When the flag information is in the second logic state, i.e., logic high state in this way, the response time improvement is achieved using the following method.

As shown in FIG. 5, the current data Pn in the third frame has a gray level of 250 while the previous data Pn−1 has a gray level of 240. In this case, the liquid crystal panel data PO generated according to the interpolation method as described above has a gray level of 255. Here, the liquid crystal pixels are accelerated fully, and the previous data of next frame pPn accelerates the pixel as a gray level of 250. When the flag information is in the second logic state, i.e., logic high state, as described above, the liquid crystal panel output interpolator 240 determines that MSB of the current data Pn is in the second logic state so that it generates the liquid crystal panel data PO at a maximum gray level. Also in this case, since the previous data of next frame pPn is the same as the current data Pn and the improvement in the response time of the liquid crystal panel occurs, the flag information corresponding to the mapped panel characteristic value TpPn is in the first logic state. Thus, the liquid crystal panel interpolator 240 generates the liquid panel data PO at a gray level of 255 using Equation (1) while the frame memory output interpolator 260 generates the previous data of next frame pPn at a gray level of 250 using Equation (1).

A method to improve the response time of the liquid crystal when the current data Pn has a large gray level value has been described with reference to the third frame shown in FIG. 5. The same applies when the current data Pn has a small gray level value. That is, when the current data Pn has a small gray level value and the flag information is in the second logic state, i.e., the logic high state, the liquid crystal panel output interpolator 240 determines that MSB of the current data Pn is in the first logic state so that it generates the liquid crystal panel data PO at a minimum gray level 0.

As described above, in a response time accelerator for driving an LCD according to the present invention, the acceleration unit 130 reads the previous data Pn−1corresponding to input current data Pn from the frame memory unit 110 for updating and storing one or more frames of previous data. The acceleration unit 130 then reads the predetermined mapped panel output value TPO, predetermined mapped panel characteristic value TpPn, and flag information corresponding to the previous data Pn−1 and current data Pn from the table memory unit 120 for storing predetermined mapped panel output values TPOs, predetermined mapped panel characteristic values TpPns, and flag information corresponding to the predetermined mapped panel characteristic values TpPns, and decodes the read information. The acceleration unit 130 performs interpolations on the decoded mapped panel output value TPO and mapped panel characteristic value TpPn and generates liquid crystal panel data PO to be output to the liquid crystal panel and previous data of next frame pPn to be output to the frame memory unit 110.

In the drawings and specification, there have been disclosed preferred embodiments of the invention and, although specific terms have been employed, they have been used in a generic and descriptive sense only and not with the purpose of limiting the embodiments. Thus, it will be understood by those skilled in the art that various changes in form and details may be made therein without departing from the spirit and scope of the invention as defined by the appended claims.

Based on the foregoing description, a response time accelerator for driving an LCD according to this invention uses an interpolation method to remove a truncation error by using 8'n LSB bits while applying a truncation technique in order to utilize a table memory for n-bit MSB data, thus eliminating noise generated at regular intervals in a vertical strip pattern to be displayed on the LCD. Furthermore, the response time accelerator for driving an LCD according to this invention has the table memory for storing predetermined mapped panel output values TPOs, predetermined mapped panel characteristic values TpPns, and predetermined flag information, all of which are used for interpolation and uses the liquid crystal panel characteristic data as the previous data of next frame, thus making it possible to obtain interpolated data so that the response time of the liquid crystal improves, thereby allowing the illiquid crystal to response rapidly to data changes, even with respect to image data having extremely large or small gray level value.

What is claimed is:

1. A response time accelerator for driving a liquid crystal display (LCD) comprising:

a frame memory unit that updates and stores one or more frames of previous data;

a table memory unit that stores predetermined mapped panel output values, predetermined mapped panel characteristic values, and flag information corresponding to the predetermined mapped panel characteristic values; and an acceleration unit that reads the previous data corresponding to input current data, reads and decodes the predetermined mapped panel output value, predetermined mapped panel characteristic value, and flag information corresponding to the previous data and current data, performs interpolations on the decoded mapped panel output value and mapped panel characteristic value according to the flag information, and generates liquid crystal panel data to be output to a liquid crystal panel and previous data of a next frame to be output to the frame memory unit, wherein the acceleration unit determines a gray level at which to generate the liquid crystal panel data based on the flag information set in a previous frame, and wherein the flag information for a next frame is set based on a comparison of the current data and the previous data of a next frame.

2. The response time accelerator of claim 1, wherein the acceleration unit comprises:

a comparator that compares the current data with the previous data and outputs the liquid crystal panel data and the previous data of the next frame with the same value as the current data, or the current data and the previous data;

a coefficient generator that generates coefficients to be used for interpolation based on the current data and previous data;

a table decoder that reads and decodes the predetermined mapped panel output value, predetermined mapped panel characteristic value, and flag information corresponding to the previous data and current data;

a panel output interpolator that performs interpolation on the decoded predetermined mapped panel output value and generates the liquid crystal panel data;

a frame memory output interpolator that performs interpolation on the decoded predetermined panel characteristic value and generates the previous data of the next frame;

a panel output selector that selectively receives the output of the comparator or the output of the panel output interpolator and outputs the liquid crystal panel data; and a frame memory output selector that selectively receives the output of the comparator or output of the frame memory output interpolator and outputs the previous data of the next frame.

3. The response time accelerator of claim 1, wherein the flag information is in a first logic state when the current data is the same as the previous data of the next frame, and in a second logic state when the current data is different from the previous data of the next frame.

4. The response time accelerator of claim 2, wherein the flag information is in a first logic state when the current data is the same as the previous data of the next frame, and in a second logic state when the current data is different from the previous data of the next frame.

5. The response time accelerator of claim 1, wherein the interpolation is performed using the following equation:

$$I=Pn-1[DB-1:DB-n]$$

$$m=Pn[DB-1:DB-n]$$

$$r=Pn-1[DB-(n+1):0]$$

$$s=Pn[DB-(n+1):0]$$

$$A=\{TP(I,m)*(2^{(DB-n)}-r)+TP(I+1,m)*r\}\gg(DB-n)$$

$$C=\{TP(I,m+1)\ (2^{(DB-n)}-r)+TP(I+1,m+1)*r\}\gg(DB-n$$

$$PZ=\{A*(2^{(DB-n)}-s)+C*s\}\gg(DB-n)$$

where Pn, Pn−1, and TP denote the current data, previous data, and a mapped panel output value or a mapped panel characteristic value, respectively, and DB, n, and PZ are the number of data bits, the number of bits after truncation, and an output value, respectively.

6. The response time accelerator of claim 2, wherein the interpolation is performed using the following equation:

$$I=Pn-1[DB-1:DB-n]$$

$$m=Pn[DB-1:DB-n]$$

$$r=Pn-1[DB-(n+1):0]$$

$$s=Pn[DB-(n+1):0]$$

$$A=\{TP(I,m)*(2^{(DB-n)}-r)+TP(I+1,m)*r\}\gg(DB-n)$$

$$C=\{TP(I,m+1)(2^{(DB-n)}-r)+TP(I+1,m+1)*r\}\gg(DB-n)$$

$$PZ=\{A*(2^{(DB-n)}-s)+C*s\}\gg(DB-n)$$

where Pn, Pn−1, and TP denote the current data, previous data, and a mapped panel output value or a mapped panel characteristic value, respectively, and DB, n, and PZ are the number of data bits, the number of bits after truncation, and an output value, respectively.

7. The response time accelerator of claim 1, wherein in performing the interpolation when the flag information is in a second logic state, the liquid crystal panel data is obtained by interpolation at a minimum gray level value if the most significant bit (MSB) of the current data is in a first logic state and at a maximum gray level value if the MSB of the current data is in a second logic state.

8. The response time accelerator of claim 2, wherein in performing the interpolation when the flag information is in a second logic state, the liquid crystal panel data is obtained by interpolation at a minimum gray level value if the most significant bit (MSB) of the current data is in a first logic state and at a maximum gray level value if the MSB of the current data is in a second logic state.

9. The response time accelerator of claim 1, wherein the predetermined mapped panel output values correspond one-to-one to gray level values determined by MSB bits of the current data and previous data.

10. The response time accelerator of claim 2, wherein the predetermined mapped panel output values correspond one-to-one to gray level values determined by MSB bits of the current data and previous data.

11. The response time accelerator of claim 1, wherein the predetermined mapped panel characteristic values correspond one-to-one to gray level values determined by MSB bits of the current data and previous data.

12. The response time accelerator of claim 2, wherein the predetermined mapped panel characteristic values correspond one-to-one to gray level values determined by MSB bits of the current data and previous data.

13. The response time accelerator of claim 2, wherein the comparison is performed using the following equation:

$$|(Pn-1)-(Pn)|\leqq THV\rightarrow PO=Pn,pPn=Pn$$

where Pn−1, Pn, and THV denote the previous data, the current data, and a predetermined threshold value, respectively, and PO and pPn are the liquid crystal panel data and previous data of the next frame.

14. A method for improving a response time of a liquid crystal panel performed in a response time accelerator having a frame memory unit for updating and storing one or more frames of previous data, a table memory unit for storing predetermined mapped panel output values, predetermined mapped panel characteristic values, and flag information corresponding to the predetermined mapped panel characteristic values, and an acceleration unit for generating data to be output to the liquid crystal panel, the method comprising the steps of:

receiving current data in the acceleration unit;

reading the previous data corresponding to the current data in the acceleration unit;

reading and decoding the predetermined mapped panel output value, predetermined mapped panel characteristic value, and flag information corresponding to the previous data and current data in the acceleration unit;

performing interpolation on the decoded predetermined mapped panel output value according to the flag information and generating liquid crystal panel data to be output to the liquid crystal panel in the acceleration unit; and performing interpolation on the decoded predetermined mapped panel characteristic value according to the flag information and generating previous data of a next frame to be output to the frame memory unit in the acceleration unit, wherein the acceleration unit determines a gray level at which to generate the liquid crystal panel data based on the flag information set in a previous frame, and wherein the flag information for a next frame is set based on a comparison of the current data and the previous data of a next frame.

15. The method of claim 14, further comprising the step of comparing the current data with the previous data and outputting the liquid crystal panel data and previous data of the next frame with the same value as the current data, or the current data and previous data.

16. The method of claim 14, wherein the flag information is in a first logic state when the current data is the same as the previous data of the next frame, and in a second logic state when the current data is different from the previous data of the next frame.

17. The method of claim 14, wherein the interpolation is performed using the following equation:

$$I=Pn-1[DB-1:DB-n]$$

$$m=Pn[DB-1:DB-n]$$

$$r=Pn-1[DB-(n+1):0]$$

$$s=Pn[DB-(n+1):0]$$

$$A=\{TP(I,m)*(2^{(DB-n)}-r)+TP(I+1,m)*r\}\gg(DB-n)$$

$$C=\{TP(I,m+1)\ (2^{(DB-n)}-r)+TP(I+1,m+1)*r\}\gg(DB-n$$

$$PZ=\{A*(2^{(DB-n)}-s)+C*s\}\gg(DB-n)$$

where Pn, Pn−1, and TP denote the current data, previous data, and a mapped panel output value or a mapped panel characteristic value, respectively, and DB, n, and PZ are the number of data bits, the number of bits after truncation, and an output value, respectively.

18. The method of claim 14, wherein in performing the interpolation when the flag information is in a second logic state, the liquid crystal panel data is obtained by interpolation at a minimum gray level value if the most significant bit (MSB) of the current data is in a first logic state and at a maximum gray level value if the MSB of the current data is in a second logic state.

19. The method of claim 14, wherein the predetermined mapped panel output values correspond one-to-one to gray level values determined by MSB bits of the current data and previous data.

20. The method of claim 14, wherein the predetermined mapped panel characteristic values correspond one-to-one to gray level values determined by MSB bits of the current data and previous data.

21. The method of claim 15, wherein the comparison is performed using the following equation:

$$|(Pn-1)-(Pn)|\leqq THV\rightarrow P0=Pn,pPn=Pn$$

where Pn−1, Pn, and THV denote the previous data, the current data, and a predetermined threshold value, respectively, and PG and pPn are the liquid crystal panel data and previous data of the next frame.

22. The response time accelerator of claim 1, wherein the acceleration unit determines based on the flag information set in the previous frame whether or not to generate the liquid crystal panel data at a maximum level or a minimum level.

23. The response time accelerator of claim 3, wherein the acceleration unit generates the liquid crystal panel data at a maximum level or a minimum level, if the flag information set in the previous frame is in the second logic state.

24. The response time accelerator of claim 1, wherein the acceleration unit generates the liquid crystal panel data which is the same as the current data and generates the previous data of the next frame which is the same as the current data, if the difference between the previous data and the current data is within a predetermined range.

25. The response time accelerator of claim 1, wherein the previous data of the next frame is obtained by performing interpolation in such a way as to predict the response characteristics of the panel.

26. The method of claim 14, wherein the acceleration unit determines whether to fully accelerate the liquid crystal panel data based on the flag information set in the previous frame.

27. A response time accelerator for driving a liquid crystal display (LCD) comprising:

a frame memory unit that stores one or more frames of previous data;

a table memory unit that stores flag information; and an acceleration unit that performs interpolation on current data based on flag information set in a previous frame, to generate previous data of a next frame and liquid crystal panel data, and generates flag information for a next frame based on a comparison of the current data and the previous data of a next frame.

28. The response time accelerator of claim 27, wherein the acceleration unit determines based on the flag information set in the previous frame whether or not to generate the liquid crystal panel data at a maximum level or a minimum level.

29. The response time accelerator of claim 27, wherein the acceleration unit generates the liquid crystal panel data which is the same as the current data and generates the previous data of the next frame which is the same as the current data, if the difference between a previous data and the current data is within a predetermined range, wherein the previous data is the previous data of the next frame set in the previous frame.

* * * * *

UNITED STATES PATENT AND TRADEMARK OFFICE

CERTIFICATE OF CORRECTION

PATENT NO. : 7,400,311 B2
APPLICATION NO. : 10/697207
DATED : July 15, 2008
INVENTOR(S) : Seok-Joon Park et al.

It is certified that error appears in the above-identified patent and that said Letters Patent is hereby corrected as shown below:

Column 3, Line 40; Column 4, Line 45; Column 7, Line 12;
Column 13, Line 32; Column 13, Line 51 and Column 15, Line 21; delete
"$I =$" and insert -- $l =$ --.

Column 3, Line 47; Column 4, Line 52; Column 7, Line 19;
Column 13, Line 39; Column 13, Line 58 and Column 15, Line 28; delete
"$A = \{TP(I,m)*(2^{(DB-n)}-r)+TP(I+1,m)*r\} \gg (DB-n)$" and insert
-- $A = \{TP(l,m)*(2^{(DB-n)}-r)+TP(l+1,m)*r\} \gg (DB-n)$ --.

Column 3, Line 49; Column 4, Line 54;
Column 7, Line 21 and Column 13, Line 60; delete
"$C = \{TP(I,m+1)(2^{(DB-n)}-r)+TP(I+1,m+1)*r\} \gg (DB-n)$" and insert
-- $C = \{TP(l,m+1)(2^{(DB-n)}-r)+TP(l+1,m+1)*r\} \gg (DB-n)$ --.

Column 13, Line 41 and Column 15, Line 30, delete
"$C = \{TP(I,m+1)(2^{(DB-n)}-r)+TP(I+1,m+1)*r\} \gg (DB-n$" and insert
-- $C = \{TP(l,m+1)(2^{(DB-n)}-r)+TP(l+1,m+1)*r\} \gg (DB-n)$ --.

Column 7, Lines 38 and 41, delete "(I, m)»4" and insert -- ($l$, m)»4 --.

Column 7, Line 39, delete "(I, m)" and insert -- ($l$, m) --.

Column 8, Line 55, delete "I" after "sultants" and insert -- $l$ --.

Column 9, Lines 27 and 28, delete
"TP(I,m), TP(I+1,m), TP(I,m+1), and TP(I+1,m+l)" and insert
-- TP($l$,m), TP($l$+1,m), TP($l$,m+1), and TP($l$+1,m+1) --.

Column 9, Line 30, delete "I=2" and insert -- $l$=2 --.

UNITED STATES PATENT AND TRADEMARK OFFICE

CERTIFICATE OF CORRECTION

PATENT NO. : 7,400,311 B2
APPLICATION NO. : 10/697207
DATED : July 15, 2008
INVENTOR(S) : Seok-Joon Park et al.

It is certified that error appears in the above-identified patent and that said Letters Patent is hereby corrected as shown below:

Column 16, Line 7, delete "PG" and insert -- PO --.

Signed and Sealed this

First Day of September, 2009

David J. Kappos

David J. Kappos
*Director of the United States Patent and Trademark Office*